US009142878B2

(12) United States Patent
Hikino et al.

(10) Patent No.: US 9,142,878 B2
(45) Date of Patent: Sep. 22, 2015

(54) ANTENNA AND PORTABLE WIRELESS TERMINAL

(75) Inventors: Nozomu Hikino, Osaka (JP); Hiroyuki Takebe, Osaka (JP); Mikio Kuramoto, Osaka (JP); Hiroyasu Suetake, Osaka (JP); Toshinori Kondo, Osaka (JP)

(73) Assignee: SHARP KABUSHIKI KAISHA, Osaka (JP)

( * ) Notice: Subject to any disclaimer, the term of this patent is extended or adjusted under 35 U.S.C. 154(b) by 474 days.

(21) Appl. No.: 13/580,484

(22) PCT Filed: Feb. 22, 2011

(86) PCT No.: PCT/JP2011/053865

§ 371 (c)(1),
(2), (4) Date: Aug. 22, 2012

(87) PCT Pub. No.: WO2011/105380

PCT Pub. Date: Sep. 1, 2011

(65) Prior Publication Data

US 2012/0319906 A1 Dec. 20, 2012

(30) Foreign Application Priority Data

Feb. 24, 2010 (JP) ..... 2010-039288

(51) Int. Cl.

| | |
|---|---|
| ***H01Q 9/04*** | (2006.01) |
| ***H01Q 1/24*** | (2006.01) |
| ***H01Q 9/42*** | (2006.01) |
| ***H01Q 5/40*** | (2015.01) |

(52) U.S. Cl.
CPC ..... *H01Q 1/243* (2013.01); *H01Q 5/40* (2015.01); *H01Q 9/42* (2013.01)

(58) Field of Classification Search
CPC ..... H01Q 9/04
USPC ..... 343/700 MS
See application file for complete search history.

(56) References Cited

U.S. PATENT DOCUMENTS

| | | | | |
|---|---|---|---|---|
| 2004/0004571 | A1* | 1/2004 | Adachi et al. | 343/700 MS |
| 2005/0259010 | A1 | 11/2005 | Soutome | |
| 2007/0222688 | A1 | 9/2007 | Sugiyama | |
| 2011/0037676 | A1 | 2/2011 | Kobayashi et al. | |

FOREIGN PATENT DOCUMENTS

| | | |
|---|---|---|
| CN | 200956405 Y | 10/2007 |
| JP | 2007-36338 A | 2/2007 |

(Continued)

OTHER PUBLICATIONS

International Search Report issued in PCT/JP2011/053865 mailed May 31, 2011.

*Primary Examiner* — Dameon E Levi
*Assistant Examiner* — Andrea Lindgren Baltzell
(74) *Attorney, Agent, or Firm* — Birch, Stewart, Kolasch & Birch, LLP

(57) ABSTRACT

An antenna includes a first antenna element, a second antenna element, and a third antenna element. The second antenna element is placed between the first antenna element and the third antenna element. A first connecting end, a second connecting end, and a third connecting end are each placed in a position that is closer to a third apical end than to a first apical end. Thus, even in the case of an antenna including three antenna element that are used for an identical system, the antenna can be provided with a suppressed difference in radiation efficiency among frequency bands to which the antenna elements respectively correspond.

15 Claims, 7 Drawing Sheets

FOREIGN PATENT DOCUMENTS

| | | | |
|---|---|---|---|
| JP | 2007-266669 | A | 10/2007 |
| JP | 2008-205991 | A | 9/2008 |
| JP | 2008-252507 | A | 10/2008 |
| JP | 2008-283631 | A | 11/2008 |
| WO | WO 2005/004282 | A1 | 1/2005 |
| WO | WO 2009/130881 | A1 | 10/2009 |

* cited by examiner

ANTENNA AND PORTABLE WIRELESS TERMINAL

TECHNICAL FIELD

The present invention relates to an antenna including three antenna elements and a portable wireless terminal including such an antenna.

BACKGROUND ART

Along with a rapid spread of portable wireless terminals over the last few years, there have been worldwide scarcities in available frequency resources. Further, along an increase in rich content and a growing diversity of services, there has been a growing market demand for large-capacity and high-speed communications. In response, for the expansion of frequencies available to the existing third-generation system (3G, 3rd Generation) and the adaptation to the next-generation system (LTE: Long Term Evolution) to handle large-capacity and high-speed communications, Mid-Band (1.5 GHz band for WCDMA Band IX) has become available to portable wireless terminals, in addition to the conventional Low-Band (800 to 900 MHz band for WCDMA, CMDA 2000, AMPS, EGSM, etc.) and High-Band (1700 to 2100 MHz band for WCDMA, CMDA 2000, DCS, PCS, etc.). Furthermore, as portable wireless terminals have become more and more multifunctional, the adaptation to various wireless communications systems, such as international roaming, One Seg (Japanese terrestrial digital broadcasting service for mobile devices) viewing, GPS, wireless LAN, Bluetooth, etc., has become essential. Under such circumstances, as for antennas that are built in portable wireless terminals, the placement of a plurality of antenna elements within a limited space has been required.

The placement of antenna elements at enough space from each other with respect to the wavelengths in the frequency bands to which the antenna elements respectively correspond makes it possible to suppress deterioration due to mutual interference between each antenna element and the other while securing the characteristics of each antenna element. However, for the realization of multifunctionality as mentioned above in addition to reductions in size and thickness of portable wireless terminals, it has become essential to place a plurality of antenna elements in a certain part within a wireless terminal.

In the case of a wireless terminal including an antenna composed of a plurality of antenna elements, i.e., in the case of a straight-type portable wireless terminal composed of a single housing, the antenna is usually placed in an edge portion of the housing that extends along a long side of the housing. In the case of a portable wireless terminal composed of two housings on the operation side and the display side and having a hinge section via which the two housing are rotatably connected to each other, such as a foldable portable wireless terminal or a biaxial-rotation portable wireless terminal, the antenna is usually placed in a region where a sizable space can be secured, such as the hinge section or an edge portion of the operation-side housing opposite the hinge. In so doing, the placement of each antenna element is very important in considering the characteristics of the antenna. In particular, in the case of a complex antenna including three antenna elements, it is very useful to provide a more preferable placement of each antenna element.

Patent Literature 1 discloses a conventional technology for placing three antenna elements in an identical space.

CITATION LIST

Patent Literature 1

Japanese Patent Application Publication, Tokukai, No. 2008-252507 A (Publication Date: Oct. 16, 2008)

SUMMARY OF INVENTION

Technical Problem

In Patent Literature 1, a loop electrode is placed so that its apical-end region is on the side of an end portion of an antenna placement region that is close to the ground, at the sacrifice of antenna characteristics in the frequency band to which the loop electrode corresponds. In another embodiment of Patent Literature 1, a monopole electrode is placed so that its apical-end region is in an end portion of the antenna placement region that is close to the ground, at the sacrifice of antenna characteristics in the frequency band to which the monopole electrode corresponds. Thus, the technology described in Patent Literature 1 is configured such that three antenna elements cannot be placed without sacrificing antenna characteristics in the frequency band to which at least any one of the antenna elements corresponds.

Meanwhile, in the case of use of three antenna elements for an identical system, it is preferable that there be no difference in radiation efficiency among the frequency bands to which all the antenna elements respectively correspond, so that a communication state is maintained without a load no matter in which frequency band a connection to a base station network is made.

Further, even if antenna elements for use in different systems from each other have their connecting ends distant from each other, the antenna elements are connected to each separate wireless-section circuit. This gives a degree of freedom of component layout on a circuit substrate, thus making it possible to place the wireless-section circuits near the respective antenna elements connected thereto. Meanwhile, in a case where antenna elements for use in an identical system have their connecting ends distant from each other, any one of the antenna elements has its connecting end distant from the wireless-section circuit to which the antenna element is connected, so that there occurs a loss due to a length of wire on the circuit substrate. Furthermore, provision of an unwanted wire brings about a demeritorious decrease in wiring region on the circuit substrate.

Thus, in the case of use of three antenna elements for an identical system, unlike in the case of use of each antenna element is used for a plurality of systems as in the case of the conventional technology, requirements (A) and (B) are imposed: (A) none of the antenna elements has its antenna characteristics sacrificed; and (B) the connecting parts of the antenna elements to the wireless-section circuits are not distant from each other. However, the configuration of Patent Literature 1 cannot satisfy the requirement (A) or (B). The present invention has been made in view of the foregoing problems, which arises in a case where three antenna elements are used for an identical system, and it is a main object to provide an antenna including three antenna elements, wherein even in a case where the antenna elements are used for an identical system, the difference in radiation efficiency among the frequency bands to which the antenna elements respectively correspond is suppressed.

Solution to Problem

In order to solve the foregoing problems, an antenna according to the present invention is an antenna including: a first antenna element which operates in a first frequency band; a second antenna element which operates in a second frequency band that is higher than the first frequency band and which is shorter than the first antenna element; and a third antenna element which operates in a third frequency band that is higher than the second frequency band and which is shorter than the second antenna element, the first, second, and third antenna elements including (i) first, second, and third connecting ends via which the first, second, and third antenna elements are connected to a wireless-section circuit, respectively, (ii) first, second, and third apical ends opposite the first, second, and third connecting ends, respectively, and (iii) first, second, and third apical-end regions including the first, second, and third apical ends, respectively, the second antenna element being placed between the first antenna element and the third antenna element, or the first antenna element being placed between the second antenna element and the third antenna element, the first, second, and third connecting ends being each placed in a position that is closer to the third apical end than to the first apical end.

According to the foregoing configuration, the antenna according to the present invention includes: the first antenna element, which is the longest among the three antenna elements; the second antenna element; and the third antenna element, which is the shortest among the three antenna elements.

For placing such antenna elements while eliminating the difference in radiation efficiency among the frequency bands to which all the antenna elements respectively correspond, it is preferable that the first, second, and third apical-end regions, which most greatly affect antenna characteristics, be placed so as not to be interposed between or covered with any other antenna elements, so that the electromagnetic waves they emit are unlikely to be blocked. According to the foregoing configuration, the third antenna element, which is shortest, is not placed between the two other antenna elements. For example, the third antenna element 113, which is shortest, is placed adjacent to either one of the two other antenna elements, and the other one of the two other antenna elements is placed on the opposite side of the third antenna element with the either one of the two other antenna elements interposed therebetween. With this, none of the antenna elements any longer has its electromagnetic waves blocked by any other one of the antenna elements. That is, this makes it possible to suitably suppress deterioration in antenna characteristics due to a decrease in open space facing the third antenna element interposed between or covered with the two other antenna elements.

Furthermore, for placing the first, second, and third connecting ends 111*b* to 113*b* so that they are not distant from each other, it is necessary that the distance from the area in which the first, second, and third connecting ends are placed to each of the apical ends of the antenna element be such that the distance from the area to the first apical end is longest and that the distance from the area to the third apical end is shortest. This is because the first antenna element is the longest and the third antenna element is the shortest among the antenna elements.

According to the foregoing configuration, the second antenna element is placed between the first antenna element and the third antenna element. Therefore, the first, second, and third apical-end regions are arranged in this order. Moreover, the first, second, and third connecting ends are placed in a position that is closer to the third apical end than to the first apical end. Accordingly, the distance from the area in which the first, second, and third connecting ends are placed to each of the apical ends of the antenna elements satisfies the aforementioned conditions. Consequently, the foregoing configuration makes it possible to achieve an antenna having antenna elements whose connecting parts to a wireless-section circuit are not distant from each other.

Thus, the foregoing configuration makes it possible to achieve an antenna that satisfies the requirements (A) and (B): (A) none of the antenna elements has its antenna characteristics sacrificed; and (B) the connecting parts of the antenna elements to the wireless-section circuits are not distant from each other. This makes it possible to provide an antenna wherein even in a case where the antenna elements are used for an identical system, the difference in radiation efficiency among the frequency bands to which the antenna elements respectively correspond is suppressed.

Further, an antenna according to the present invention may be an antenna connected to a conductive member provided with a wireless-section circuit, including: a first antenna element which operates in a first frequency band; a second antenna element which operates in a second frequency band that is higher than the first frequency band and which is shorter than the first antenna element; and a third antenna element which operates in a third frequency band that is higher than the second frequency band and which is shorter than the second antenna element, the first, second, and third antenna elements including (i) first, second, and third connecting ends via which the first, second, and third antenna elements are connected to the wireless-section circuit, respectively, (ii) first, second, and third apical ends opposite the first, second, and third connecting ends, respectively, and (iii) first, second, and third apical-end regions including the first, second, and third apical ends, respectively, the first, second, and third apical ends being each placed at a certain end of an antenna placement region in which the antenna is placed, the first, second, and third apical ends being placed farthest in the antenna from the conductive member, the first, second, and third apical ends being not covered with any other one of the antenna elements as seen from a side opposite to a side on which the conductive member is placed, the first, second, and third antenna elements being arranged in this order with increasing distances from a place that is close to the conductive member, the first, second, and third connecting ends being each placed in a position that is closer to the third apical end than to the first apical end. The antenna thus configured can also bring about the same effects as the aforementioned antenna can.

An antenna according to the present invention is suitably applicable also in case where all the antenna elements are used for utilizing a plurality of system.

Advantageous Effects of Invention

An antenna according to the present invention is an antenna including at least three antenna elements with a suppressed difference in radiation efficiency among the three antenna elements, and the connecting parts of the antenna elements to the wireless-section circuit are not distant from each other. Therefore, the present invention makes it possible to provide a wireless terminal can be achieved which, even in a case where three antenna elements are used for an identical system, maintains a communication state without a load no matter in which frequency band it is connected to a base station network.

DESCRIPTION OF EMBODIMENTS

An embodiment of the present invention is described below with reference to the drawings. It should be noted that the following description assumes that an antenna according to the present invention is an antenna provided in a portable wireless terminal that performs wireless communication with a base station for a telephone call. However, the antenna according to the present invention is not limited to an antenna provided in a portable wireless terminal that performs wireless communication with a base station for a telephone call, but can be applied to an antenna in general that receives and/or transmits a carrier wave with any sort of signal superimposed thereon, and may be provided in a wireless terminal other than a portable wireless terminal.

[First Embodiment]

Figure 1:
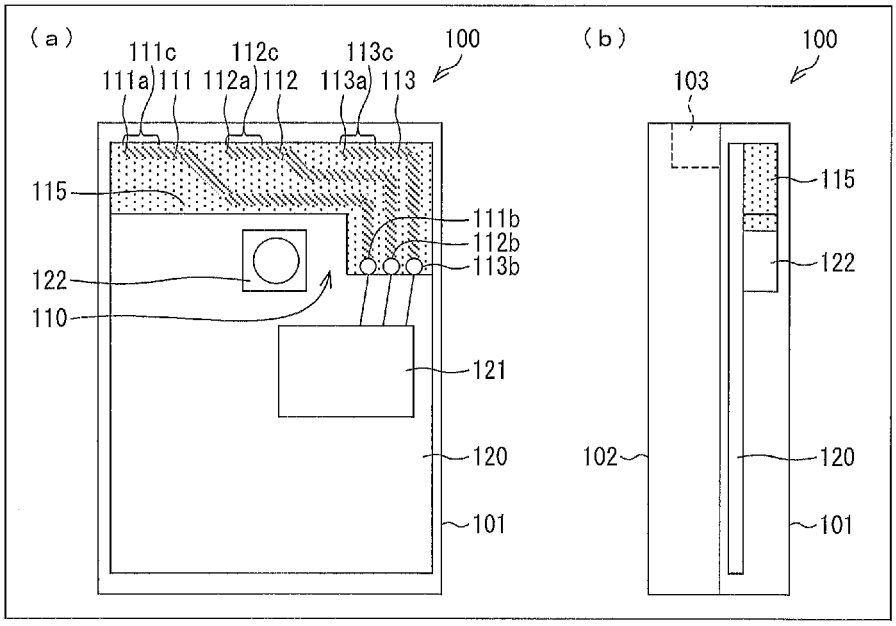
FIG. 1 is a set of diagrams (a) and (b) schematically showing a configuration of a portable wireless terminal according to an embodiment of the present invention, (a) being a top perspective view, (b) showing a side perspective view.

FIG. 1 is a set of diagrams (a) and (b) schematically showing a configuration of a portable wireless terminal 100 according an embodiment (first embodiment) of the present invention, (a) being a top perspective view of the portable wireless terminal 100, (b) being a side perspective view of the portable wireless terminal 100. The portable wireless terminal 100 includes a first housing 101 and a second housing 102 that are connected to each other via a connection member 103. The first housing 101 houses a circuit substrate 120.

Placed on the side of the circuit substrate 120 that is close to the hinge section is an antenna base 115. Provided on the antenna base 115 are a first antenna element 111, a second antenna element 112, and a third antenna element 113 that constitute an antenna 110 according to the present embodiment. It should be noted that the first, second, and third antenna elements and the antenna base 115 are collectively called "antenna assembly". Further, in this specification, the term "antenna" refers to a configuration including from the antenna elements to an antenna matching circuit.

The circuit substrate is also provided with a wireless-section circuit 121 for a cellular communication system, a camera 122, etc. The wireless section 121 serves to perform cellular communication by using three frequency bands, and is connected to all of the first, second, third antenna elements 111 to 113. Although not illustrated, an antenna matching section or the like may be provided between the first, second, third antenna elements 111 to 113 and the wireless-section circuit 121. In this specification, the term "wireless-section circuit" collectively means a circuit composed of at least any one of the following components: a transmitting circuit; a receiving circuit; a switch for changing from one antenna to another; a branching filter that causes the flow from the transmitting circuit to the antenna and the flow of a high-frequency signal from the antenna to the receiving circuit to branch off from each other; an IC; and the like.

The antenna base 115 is made of a dielectric material, a magnetic material, a ceramic material, or the like, for example, and has a thickness. Each of the antenna elements is formed by plating an antenna element shape on a top surface of the antenna base 115 (i.e., on a surface of the antenna base 115 opposite a connection surface facing the circuit substrate 120). Alternatively, each of the antenna elements may be formed, for example, by a manufacturing process, called in-mold molding or insert molding, by which a thin metal plate is processed into each separate antenna element shape and the antenna elements shapes are collectively fixed on the antenna base 115. By thus forming the first, second, and third antenna elements 111 to 113 on the antenna base 115, the first, second, and third antenna elements 111 to 113 are kept at a distance from a conductor pattern on the circuit substrate 120, so that the first, second, and third antenna elements 111 to 113 can be placed in the part of the first housing 101 that is farther from its center. Further, since all of the antenna elements are formed on the antenna base 115, none of the antenna elements is placed in such a manner as overlap any other one of the antenna elements. That is, none of the antenna elements any longer deteriorates in characteristics by having its electromagnetic waves blocked by any other one of the antenna elements.

The first, second, and third antenna elements 111 to 113 each have a portion extending onto the connection surface of the antenna base 15, and have a first connecting end 111*b*, a second connecting end 112*b*, and a third connecting end 113*b* on the connection surface, respectively. The first, second, and third connecting ends 111*b* to 113*b* are ends of the first, second, and third antenna elements 111 to 113 via which the first, second, and third antenna elements 111 to 113 are connected to the wireless-section circuit 121, respectively. The first, second, and third connecting ends 111*b* to 113*b* are connected to wires on the circuit substrate 120 via connecting terminals such as springs provided on the circuit substrate 120 facing the connection surface or via parts including the first, second, and third connecting ends 111*b* to 113*b* and having spring characteristics, so that the first, second, and third antenna elements 111 to 113 are connected to the wireless-section circuit 121.

The first, second, and third antenna elements 111 to 113 also have a first apical end 111*a*, a second apical end 112*a*, and a third apical end 113*a* on the top surface of the antenna base 115, respectively. The first, second, and third apical ends 113*a* to 113*c* are ends of the first, second, and third antenna elements 111 to 113 opposite the first, second, and third connecting ends 111*b* to 113*b*, respectively. The first, second, and third apical ends 113*a* to 113*c* are open ends without being connected to any other conducting material. Further, the region around the first apical end 111*a* of the first antenna element 111 (including the first apical end 111*a*) is referred to as "first apical-end region 111*c*". Similarly, the region around the second apical end 112*a* of the second antenna element 112

(including the second apical end 112*a*) is referred to as "second apical-end region 112*c*", and the region around the third apical end 113*a* of the third antenna element 113 (including the third apical end 113*a*) is referred to as "third apical-end region 113*c*".

The first, second, and third antenna element 111 to 113 operate in first, second, and third frequency bands, respectively, with the first, second, and third frequency bands in the order of ascending frequencies. The present embodiment is described by taking, as an example, a case where the first frequency band is an 800 to 900 MHz band for WCDMA, CDMA2000, AMPS, EGSM, LTE, etc., where the second frequency band is a 1.5 GHz band for WCDMA Band XI, LTE, etc., and where the third frequency band is a 1.7 to 2.1 GHz band for WCDMA, CDMA2000, DCS, PCS, LTE, etc. However, the present invention is not limited to such an example, but can be applied as long as the second frequency band is higher than the first frequency band and the third frequency band is higher than the second frequency band.

Further, in general, the length of an antenna element is inversely proportional to the operating frequency. That is, an antenna element in a low-frequency band is longer than that in a high-frequency band. Therefore, the first, second, and third antenna elements 111 to 113 are in the order of descending lengths.

As shown in (a) of FIG. 1, the first, second, and third apical-end regions 111*c* to 113*c* are each placed at an end of the antenna 110 that is close to the outer edge of the first housing 101, with the second antenna element 112 being placed between the first antenna element 111 and the third antenna element 113, and the first, second, and third connecting ends 111*b* to 113*b* are each placed in a position that is close to the third apical end 113*a* than to the first apical end 111*a*.

That is, the placement of the first, second, and third apical-end regions 111*c* to 113*c* at an end of the antenna 110 that is close to the outer edge of the first housing 101 makes the characteristics of the first, second, and third antenna elements 111 to 113 satisfactory, and none of the antenna elements needs to have its antenna characteristics sacrificed. In other words, the need to increase the antenna size of the first, second, and third antenna elements 111 to 113 in order to secure the characteristics of the first, second, and third antenna elements 111 to 113 is lessened, and the recent demand for reductions in size and thickness of portable wireless terminals can be met.

Further, in a different perspective, the first, second, and third apical-end regions 111*c* to 113*c* are not covered with any other antenna element as seen from the side opposite to the side on which conductive members such as the wireless-section circuit 121 and the camera 122 are provided, none of the first, second, and third antenna elements 111 to 113 needs to have its antenna characteristics sacrificed.

Further, in a different perspective, since the third antenna element 3, which is shortest, is not placed between the two other antenna elements, the difference in radiation efficiency among the frequency bands to which the antenna elements respectively correspond can be suppressed. That is, for eliminating the difference in radiation efficiency among the frequency bands to which all the antenna elements respectively correspond, it is preferable that the first, second, and third apical-end regions, which most greatly affect antenna characteristics, be placed so as not to be interposed between or covered with any other antenna elements, so that the electromagnetic waves they emit are unlikely to be blocked. For that purpose, it is preferable to avoid placing the third antenna element 113, which is shortest, between the two other antenna elements. For example, the third antenna element 113, which is shortest, is placed adjacent to either one of the two other antenna elements, and the other one of the two other antenna elements is placed on the opposite side of the third antenna element with the either one of the two other antenna elements interposed therebetween. With this, none of the antenna elements any longer has its electromagnetic waves blocked by any other one of the antenna elements. That is, this makes it possible to suitably suppress deterioration in antenna characteristics due to a decrease in open space facing the third antenna element 113 interposed between or covered with the two other antenna elements. In the present embodiment, the second antenna element 112 is placed between the first antenna element 111 and the third antenna element 113. However, the first antenna element 111 may be placed between the second antenna element 112 and the third antenna element 113.

Moreover, by eliminating the difference in radiation efficiency among the frequency bands to which all the antenna elements respectively correspond, a wireless terminal can be achieved which maintains a communication state without a load no matter in which frequency band it is connected to a base station network.

Further, as shown in FIG. 1, by placing the first, second, and third apical-end regions 111*c* to 113*c* at a certain end of the antenna placement region in which each antenna is placed (e.g., of the top surface of the antenna base 115), with that end of the antenna placement region being an end that is farthest from the conductive members such as the camera 122 (i.e., being an outermost part of the first housing 101), the first, second, and third apical-end regions 111*c* to 113*c* can each be made to face open space distant from the conductive members that block the emission of electromagnetic waves. This makes it possible to alleviate the harmful effects of the conductive members on a particular antenna and easily achieve an antenna all of whose antenna elements have the same level of radiation efficiency.

Furthermore, since the second antenna element 112 is placed between the first antenna element 111 and the third antenna element 113 and the first, second, and third connecting ends 111*b* to 113*b* are each placed in a position that is close to the third apical end 113*a* than to the first apical end 111*a*, the first, second, and third connecting ends 111*b* to 113*b* can be successfully placed so that their positions are not distant from each other.

The clause "the second antenna element 112 is placed between the first antenna element 111 and the third antenna element 113" in this specification means that a large portion or at least more than half of the second antenna element 112 is placed in the space between the first antenna element 111 and the third antenna element 113. For example, as shown in FIG. 1, the clause encompasses a state in which a shadow of the second antenna element 112 as projected onto a certain plane (in FIG. 1, a plane parallel to the substrate surface of the circuit substrate 120) is interposed between shadows of the first and third antenna elements 111 and 113 as projected onto that plane. It should be noted that it is not necessary that the entire shadow of the second antenna element 112 be interposed between the shadows of the first and third antenna elements 111 and 113, and it is only necessary that 50% of the entire shadow of the second antenna element 112 be interposed between the shadows of the first and third antenna elements 111 and 113. That is, it is only necessary that a large portion of the second antenna element 112 be interposed between the first antenna element 111 and the third antenna element 113. Further, in a different perspective, the first antenna element 111, the second antenna element 112, and the third antenna element 113 include being arranged in this order along a certain direction and, preferably, are arranged in this order with increasing distances from a place that is close to the conductive members.

The following states the reasons why it is preferable that the first, second, and third antenna elements 111 to 113 be arranged in the manner described above.

First, as mentioned above, the length of each antenna element is such that the first antenna element 111 is longest, that the second antenna element 112 is shorter than the first antenna element 111, and that the third antenna element 113 is shortest. Therefore, in order for the first, second, and third connecting ends 111*b* to 113*b* to be placed in proximity to each other, it is necessary that the distance from the area in which the first, second, and third connecting ends 111*b* to 113*b* are placed to each of the first, second, and third apical ends 111*a* to 113*a* be such that the distance from the area to the first apical end 111*a* is longest and that the distance from the area to the third apical end 113*a* is shortest. It should be noted here that in a case where the first, second, and third antenna elements 111 to 113 are not arranged in such a manner, it is difficult to satisfy such a condition.

That is, in the present embodiment, either the second antenna element 112 is placed between the first antenna element 111 and the third antenna element 113, or the first antenna element 111, the second antenna element 112, and the third antenna element 113 are arranged in this order along a certain direction. Therefore, the first, second, and third apical-end regions 111*c* to 113*c* are arranged in the order from the first apical-end region 111*c* through the second apical-end region 112*c* to the third apical-end region 113*c*. Moreover, in the present embodiment, since the first, second, and third connecting ends 111*b* to 113*b* are each placed in a position that is close to the third apical end 113*a* than to the first apical end 111*a*, the distance from the area in which the first, second, and third connecting ends 111*b* to 113*b* are placed to each of the first, second, and third apical ends 111*a* to 113*a* can be made such that the distance from the area to the first apical end 111*a* is longest and that the distance from the area to the third apical end 113*a* is shortest.

By thus arranging the first, second, and third antenna elements 111 to 113 in the manner described above, the first, second, and third connecting ends 111*b* to 113*b* can be successfully brought into proximity to each other, so that the antenna characteristics can be improved. Especially preferably, the first, second, and third connecting ends 111*b* to 113*b* can each be placed inside of a circle approximately 10 mm in diameter.

Further, since the first, second, and third antenna elements correspond to each separate frequency band, the adjustment of each frequency band can be done by adjusting each antenna element independently. This allows design simplification.

Further, in the present embodiment, the first antenna element 111, the second antenna element 112, and the third antenna element 113 are formed on the same antenna base 151. This makes it possible to treat the three antenna elements as a single component, thus contributing to a reduction in the number of components to be incorporated into the wireless terminal and to an increase in efficiency of assembly of the wireless terminal.

As shown in FIG. 1, even when the first antenna element 111, the second antenna element 112, and the third antenna element 113 are formed on an identical antenna base 115, the antenna characteristics deteriorate in a case where the first, second, and third antenna elements 111 to 113 are not arranged in the manner described above. This is described with reference to FIG. 2.

Figure 2:
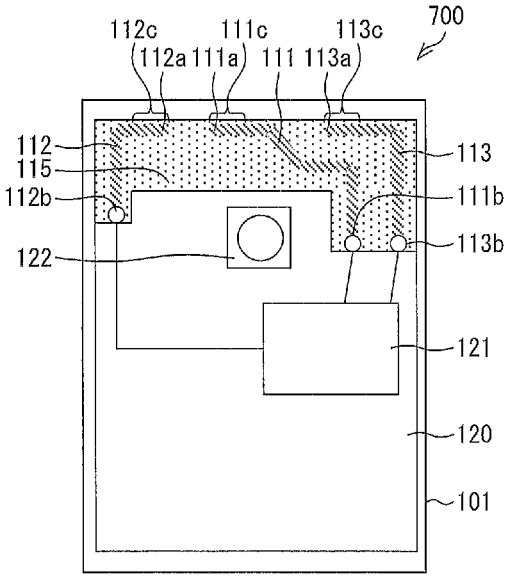
FIG. 2 is a top perspective view schematically showing a portable wireless terminal serving as a reference technology.

FIG. 2 is a diagram schematically showing a portable wireless terminal 700 according to a reference technology in which the first, second, and third antenna elements 111 to 113 are formed on the antenna base 115. In the wireless terminal 700, unlike in the wireless terminal 100, the second antenna element 112 is not placed between the first antenna element 111 and the third antenna element 113. This makes it impossible to place the first, second, and third connecting ends 111*b* to 113*b* so that they are not distant from each other, with the result that the wireless-section circuit 121 and the second connecting end 112*b* are at a distance from each other. This leads to an increase in the length of a wire connecting the wireless-section circuit 121 with the second connecting end 112*b*. This causes a great loss in the wire, with the result that the antenna characteristics deteriorate. Furthermore, an RF signal wire occupies a large amount of space on the substrate and therefore reduces the amount of space on the circuit substrate 120 in which the conductive members can be mounted, thus making a reduction in size impossible.

Next, the placement of the first, second, and third antenna elements 111 to 113 according to the present embodiment is described in more detail with reference to FIGS. 3 and 4. (a) to (d) of FIG. 3 and (a) to (f) of FIG. 4 are diagrams showing variations of antenna assembly according to the present embodiment.

Figure 3:
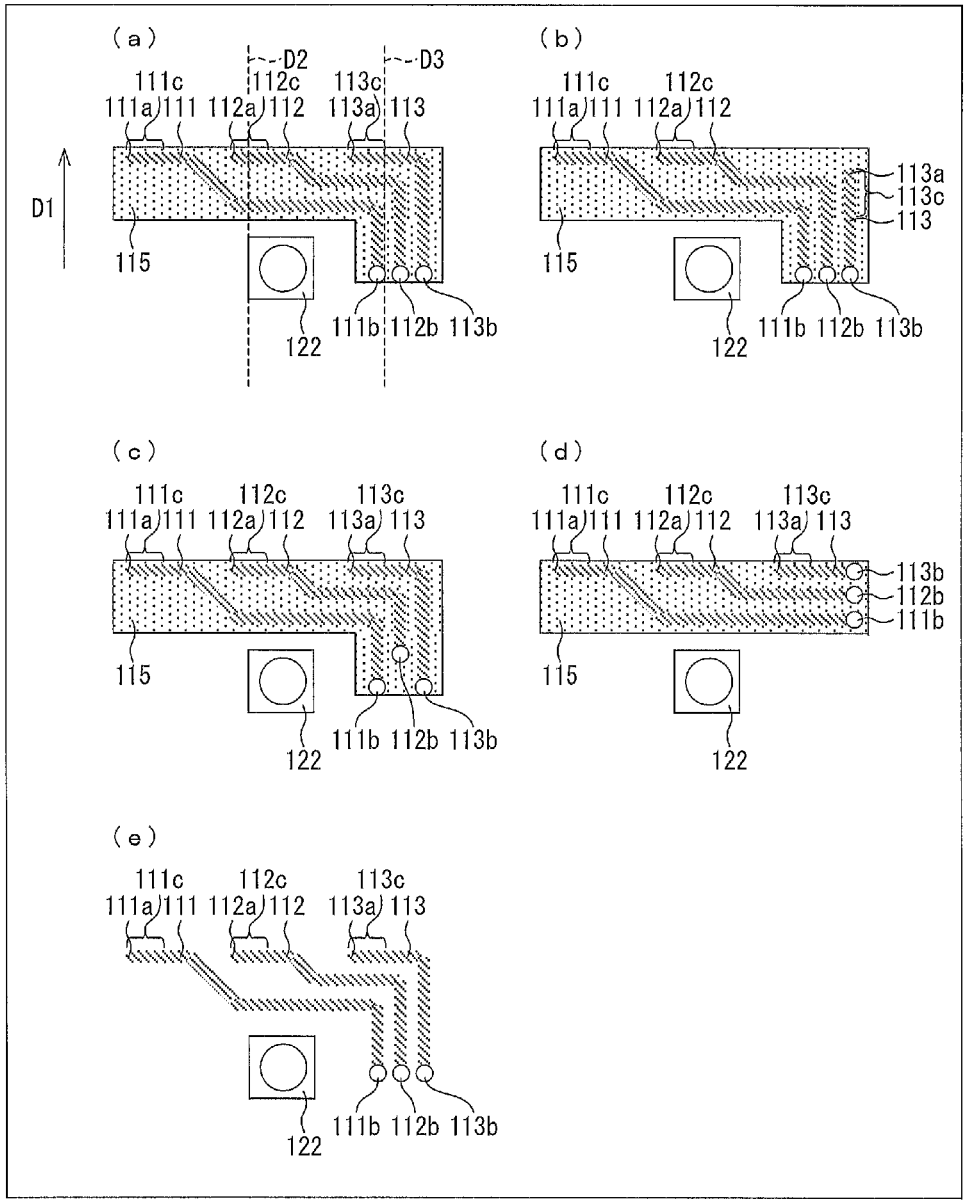
FIG. 3 is a set of diagrams showing variations of antenna according to an embodiment of the present invention.

As shown in (a) of FIG. 3, the first, second, and third apical-end regions 111*c* to 113*c* are placed at an end on the antenna base 115 in a direction D1. It should be noted the "end" does not need to be located on the boundary with the outside, but as shown in (b) of FIG. 3 and (d) and (e) of FIG. 4, the first, second, and third apical-end regions 111*c* to 113*c* may be located slightly inward. Further, as will be mentioned later, the first, second, and third apical-end regions 111*c* to 113*c* do no need to be wholly placed at the end, but each need only have at least one point placed at the end.

The first, second, third connecting ends 111*b* to 113*b* are located closer to the third apical end 113*a* with respect to a straight lime D2 between the first apical end 111*a* and the third apical end 113*a*. As shown in (c) and (d) of FIG. 3, the first, second, third connecting ends 111*b* to 113*b* may be located out of alignment in the direction D1. Further, as shown in (f) of FIG. 4 and (b) of FIG. 6, the first, second, third connecting ends 111*b* to 113*b* do not need to be arranged in this order in a direction orthogonal to the direction D1.

Figure 4:
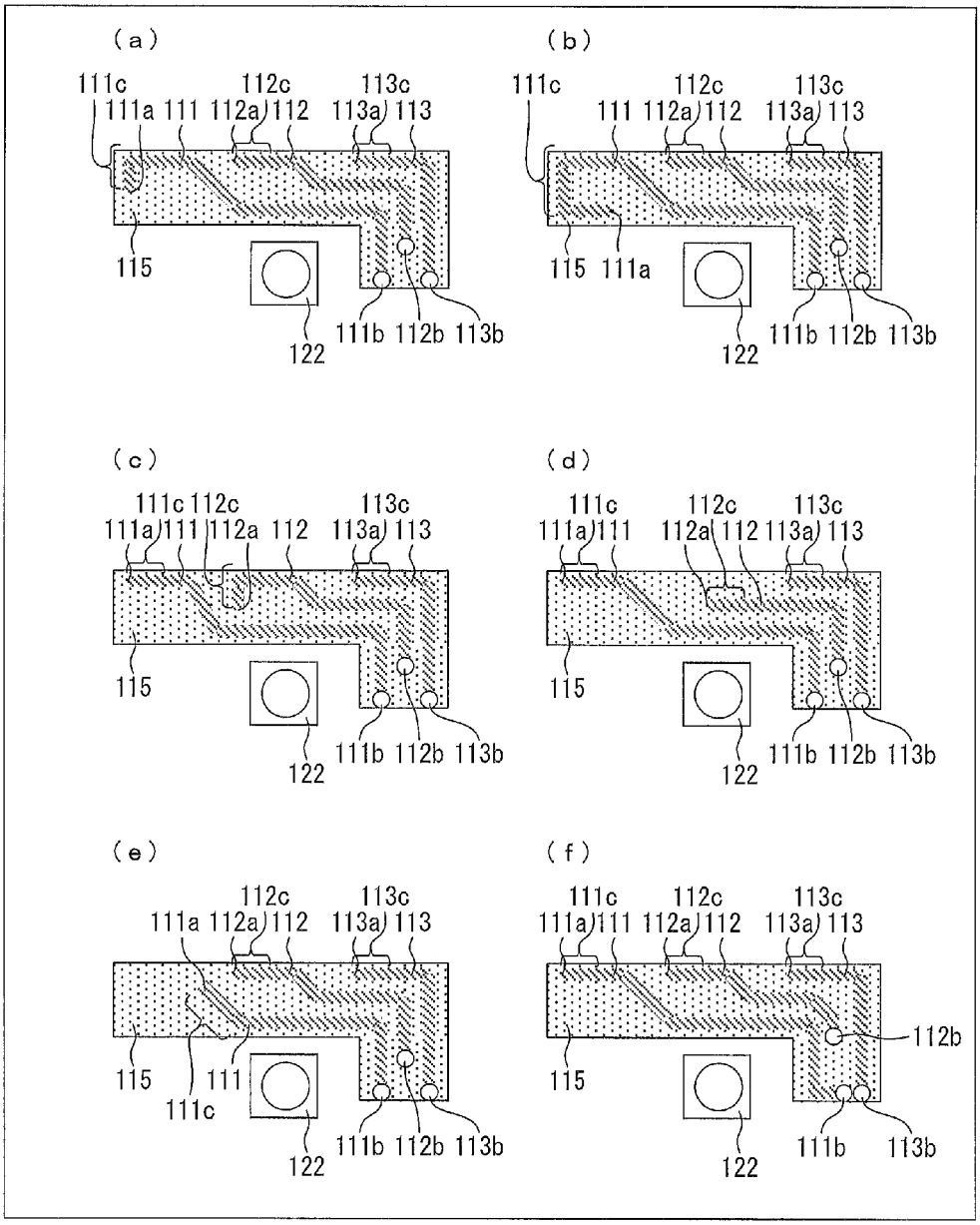
FIG. 4 is a set of diagrams showing variations of antenna according to an embodiment of the present invention.

Further, as shown in (a) to (c) of FIG. 4, as long as the first, second, and third apical-end regions 111*c* to 113*c* are placed at an end on the antenna base 115 in the direction D1, the first, second, and third apical ends 111*a* to 113*a* may extend up to a position off the end.

Moreover, the second antenna element 112 is placed between the first antenna element 111 and the third antenna element 113. This is indicated, for example, by the fact that in (a) of FIG. 3, on the straight line D2, the second antenna element 112 is located closer to a position on the straight line D2 to which the direction D1 points than the first antenna element 111 is, and the third antenna element 113 is located closer to a position on a straight line D3 to which the direction D1 points than the second antenna element 112 is.

(Modification)

Although not particularly illustrated, the antenna 110 may be placed in any place as long as it is placed at the outermost side within a range included in the first housing 101, and does not need to be placed in the hinge section as mentioned above.

Alternatively, the first, second, and third antenna elements 111 to 113 may be formed, for example, by a manufacturing process, called in-mold molding or insert molding, by which a thin metal plate is processed into each separate antenna element shape and the antenna elements shapes are collectively fixed on the antenna base 115.

Further, as mentioned above, it is preferable that the first, second, and third antenna elements 111 to 113 be formed on the antenna base 115. However, it is also possible to omit the antenna base 115. For example, it is possible to fabricate the first, second, and third antenna elements 111 to 113 on an FPC and attach the FPC to a housing case that houses the antenna or to a resin fixture. Alternatively, as shown in (e) of FIG. 3, it is possible to form the first, second, and third antenna elements 111 to 113 from sheet metal having a stereoscopic shape and attach the first, second, and third antenna elements 111 to 113 to the inner side of a housing case that houses the antenna.

Thus, as long as the first, second, and third antenna elements 111 to 113 are at least placed spatially as described above, such placement is encompassed in the present invention regardless of the manner in which the first, second, and third antenna elements 111 to 113 are formed and fixed.

[Second Embodiment]

Figure 5:
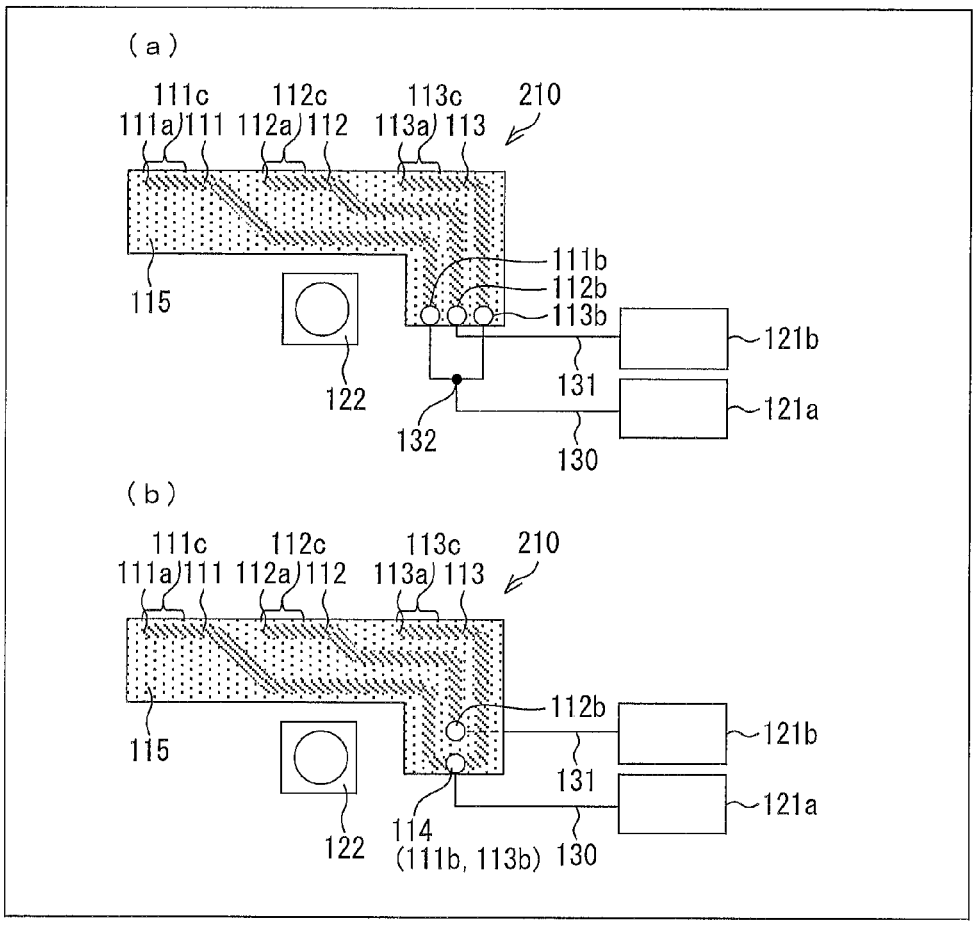
FIG. 5 is a set of diagrams showing variations of antenna according to an embodiment of the present invention, with its first and third antenna elements being connected.

Another embodiment (second embodiment) of the present invention is described with reference to FIGS. 5 through 10. It should be noted that members identical to those of the first embodiment are given the same reference signs and are not described below. FIG. 5 is a diagram schematically showing a configuration of an antenna 210 according to the present embodiment.

The antenna 210 according to the present embodiment is connected to a wireless-section circuit 121 via two wires (namely a first wire 130 and a second wire 131). The first wire 130 is connected to the first antenna element 111 and the third antenna element, and the second wire 131 is connected to the second antenna element 112. In this respect, the antenna 210 according to the present embodiment differs from the antenna 110 according to the first embodiment.

(a) of FIG. 5 shows a configuration in which the first wire 130 has a branch point 132 at which the first wire 130 divides into two wires one of which is connected to the first connecting end 111*b* and the other one of which is connected to the third connecting end 113*b*. As shown in (a) of FIG. 5, the first wire 130 divides at the branch point 132 into two wires one of which is connected to the first connecting end 111*b* and the other one of which is connected to the third connecting end 113*b*. The opposite end of the first wire 130 is connected to a first circuit load 121*a* of the wireless-section circuit 121. The second wire 131 connects the second connecting end 112*b* with a second circuit load 121*b* of the wireless-section circuit 121.

(b) of FIG. 5 shows a configuration in which the first connecting end 111*b* and the third connecting end 113*b* are merged into one. As shown in (b) of FIG. 5, the first connecting end 111*b* and the third connecting end 113*b* are merged into a single connecting end 114 on the antenna base 115, and the connection end 114 is shared by the first antenna element 111 and the third antenna element 113. The first wire 130 connects the connecting end 114 with the first circuit load 121*a* of the wireless-section circuit 121. The second wire 131 connects the connecting end 112*b* with the second circuit load 121*b* of the wireless-section circuit 121.

Figure 6:
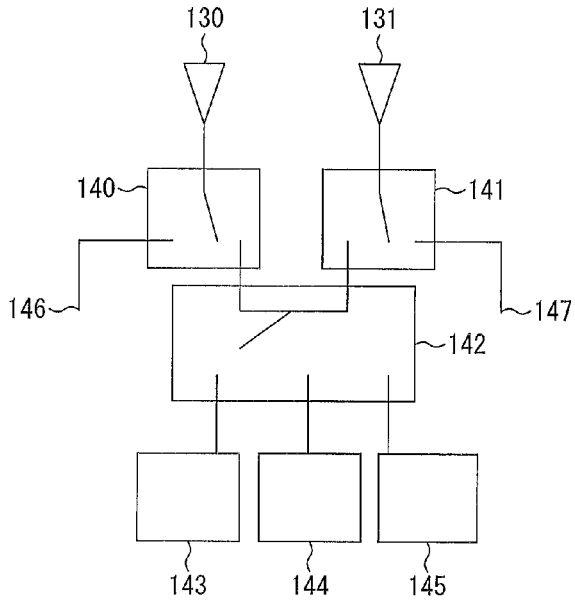
FIG. 6 is a diagram schematically showing a wireless-section circuit according to an embodiment of the present invention.

FIG. 6 is a diagram showing an example of a configuration of the wireless-section circuit 121. As shown in FIG. 6, a signal from the first wire 130 connected to the first antenna element 111 and the third antenna element is transmitted via a switch 140 to a switch 142 when the first antenna element 111 or the third antenna element is in use, and is transmitted via the switch 140 to a first not-in-use terminal 146 when the first antenna element 111 or the third antenna element is not in use. A signal from the second wire 131 connected to the second antenna element 112 is transmitted via a switch 141 to the switch 142 when the second antenna element 112 is in use, and is transmitted via the switch 141 to a second not-in-use terminal 147 when the second antenna element 112 is not in use. The first not-in-use terminal 146 and the second not-in-use terminal 147 may have impedances unique to such switching elements as those shown in FIG. 6, or may be loaded with adjustment constants in advance so that a designer can adjust them to given impedances. Depending on the antenna element being used, the switch 142 switches among a connection to a first RF circuit 143 that processes a signal in the first frequency band, a connection to a second RF circuit 144 that processes a signal in the second frequency band, and a connection to a third RF circuit 145 that processes a signal in the third frequency band. By being thus configured, the wireless-section circuit 121 has the first circuit load 121*a* and the second circuit load 121*b*.

By thus integrating some of the paths of feeding from the wireless-section circuit 121 to the antenna 210, saving of space and reducing of cost can be achieved. This is because a larger number of feeding paths require, by just that much, a larger number of connecting terminals connecting the matching circuit and the connecting ends of the antenna elements with the wires on the circuit substrate 120, thus causing an increase in the number of components and reducing the amount of space on the circuit substrate 120 in which the conductive members can be mounted.

It should be noted here that the feeding paths to the first antenna element 111 and to the third antenna element 113 are integrated because such a combination is most preferable. This is because the difference between the first frequency band, in which the first antenna element 111 operates, and the third frequency band, in which the third antenna element 113 operates, is greater than the difference between either one of the first and third frequency bands and the second frequency band, in which the second antenna element 112 operates. Furthermore, in the present embodiment, since the second frequency band has about twice as many waves as the first frequency band, the first antenna element 111 and the second antenna element 112 anti-resonate with each other. Further, since the second frequency band is in proximity to the low-pass side (near 1.7 GHz) of the third frequency band, the second frequency band and the third frequency band greatly interfere with each other, with the result that satisfactory antenna characteristics cannot be obtained. On the other hand, since the third frequency band has about three times as many waves as the first frequency band and the two frequency bands are not in proximity to each other, they little interfere with each other, with the result that satisfactory antenna characteristics can be obtained. Therefore, the feeding paths to the first antenna element 111 and to the third antenna element 113 can be suitably integrated.

Furthermore, the integration of the feeding paths to the first antenna element 111 and to the third antenna element 113 makes it possible to minimize the effects of the first antenna element 111 and the third antenna element 113 on the second antenna element 112 as below.

Figure 7:
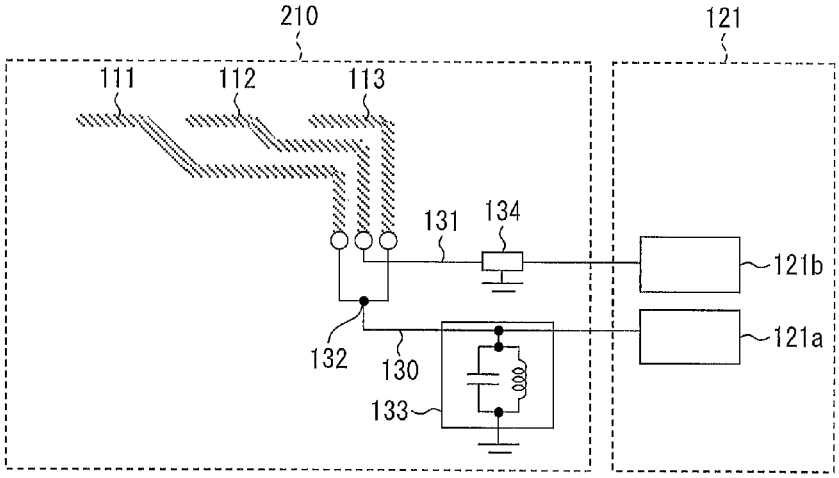
FIG. 7 is a diagram schematically showing an antenna according to an embodiment of the present invention.

When, as shown in FIG. 7, a first matching section 133 is provided between the first and third antenna elements 111 and 113 and the first circuit load 121*a* for matching the first antenna element 111 and the third antenna element 113 and a second matching section 134 is provided between the second antenna element 112 and the second circuit load 121*b* for matching the second antenna element 112, it is preferable to use, as the first matching section 133, a parallel resonant circuit provided in parallel with the first wire 130 and connected to the ground.

Figure 8:
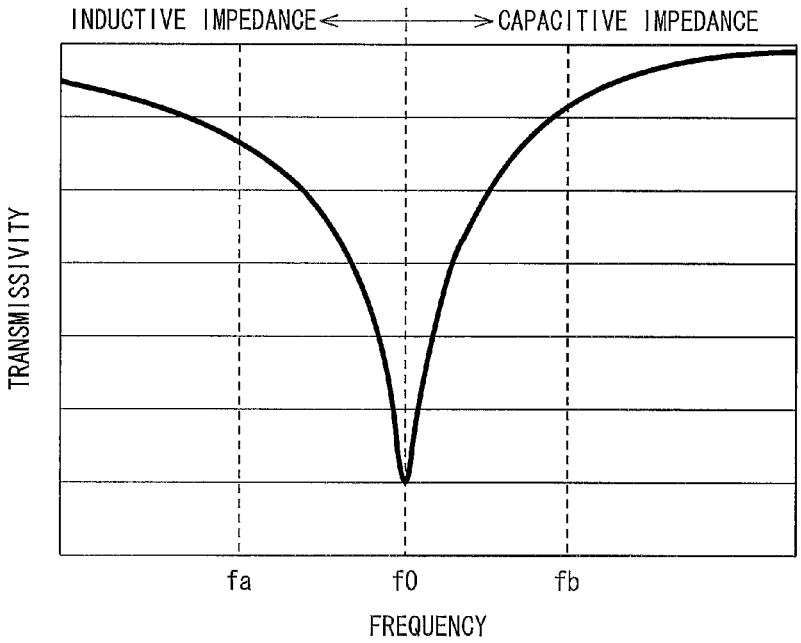
FIG. 8 is a graph showing the frequency characteristics of a parallel resonant circuit.

As shown in FIG. 8, the transmission characteristics of a parallel resonant circuit act as inductivity at a frequency lower than a resonant frequency f0 and as capacitivity at a frequency higher than the resonant frequency f0. It should be noted here that if the resonant frequency f0 is adjusted so that it falls within the third frequency band, the first matching section 133 operates substantially as an inductive element (parallel L matching circuit) for the first frequency band; therefore, the length of the first antenna element 111, which operates as a λ/4 monopole antenna, can be made slightly shorter than λ/4, so that the antenna 210 can be made in a smaller size. The third antenna element 113 can be made broader in band by resonance of the third antenna element 113 and resonance of the parallel resonant circuit. This also helps the antenna 210 to be made in a smaller size.

With it being assumed here that in Port 1 is an input terminal to the first antenna element 111 and the third antenna element 113, including the first matching section 133 in FIG. 7, and Port 2 is an input terminal to the second antenna element 122, including the second matching section 134 in FIG. 7, the behavior of an antenna input impedance as seen from Port 1 toward the first antenna element 111 and the third antenna element 113 is described. This circuit operates as an inductive element at a frequency lower than f0 of the parallel resonant circuit, so that the impedance rotates counterclockwise on a Smith chart. Then, as the frequency comes closer to f0, the amount of counterclockwise rotation decreases, and there is no rotation at f0. Meanwhile, this circuit operates as a capacitive element at a frequency higher than f0, so that the impedance rotates clockwise on a Smith chart. Then, as the frequency becomes higher, the amount of clockwise rotation increases. Therefore, the frequency characteristic of the antenna input impedance at Port 1 typically looks like that shown in the Smith chart of FIG. 9.

Figure 9:
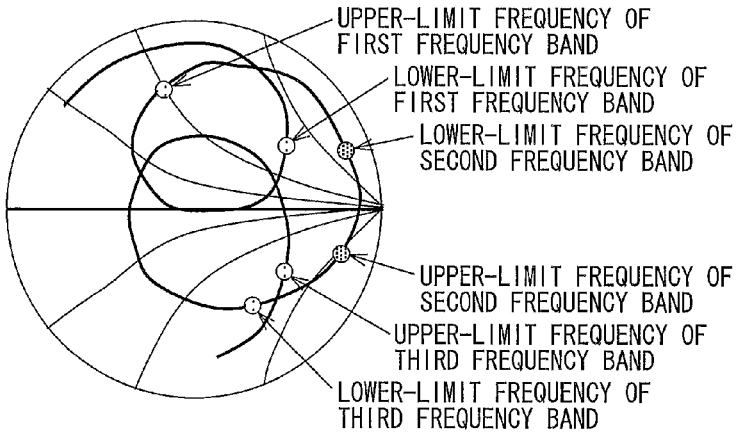
FIG. 9 is a Smith chart showing the frequency characteristics of the first and third antenna elements according to an embodiment of the present invention.

In the second frequency band, as shown in FIG. 9, the impedance as seen from Port 1 is substantially close to being open. The amount of mutual coupling between antennas is represented by the transmission amplitude from Port 1 to Port 2 (represented as |S21|, equivalent to the transmission amplitude |S12| from Port 2 to Port 1); however, if the impedance as seen from Port 1 in the second frequency band is open, |S21| becomes smaller. That is, the mutual coupling between the antennas is alleviated, so that the effects of the first antenna element 111 and the third antenna element 113 on the second antenna element 112 can be minimized.

In the antenna 210 according to the present embodiment, furthermore, at least any one of (i) the first antenna element 111, (ii) the third antenna element 113, and (iii) the first wire 130 may include a frequency control section (frequency control means) for increasing an input impedance in the second frequency band as seen from an input side of the first and third antenna elements 111 and 113. The length of each antenna element and the constant of antenna matching are affected by the conductive members (metal components, ground, etc.) in the vicinity of the antenna assembly, changes in conductor shape due to a transformable housing that can take any one of a plurality of shapes such as open/close, or the like. Therefore, the length is not always ideal. Further, these effects may have a frequency characteristic, so that the impedance does not rotate evenly on the Smith chart shown in FIG. 9. This makes readjustment necessary. As the frequency control section, a circuit element such as an inductor or a capacitor, a stub pattern having an inductive or capacitive impedance, or the like can be used.

Figure 10:
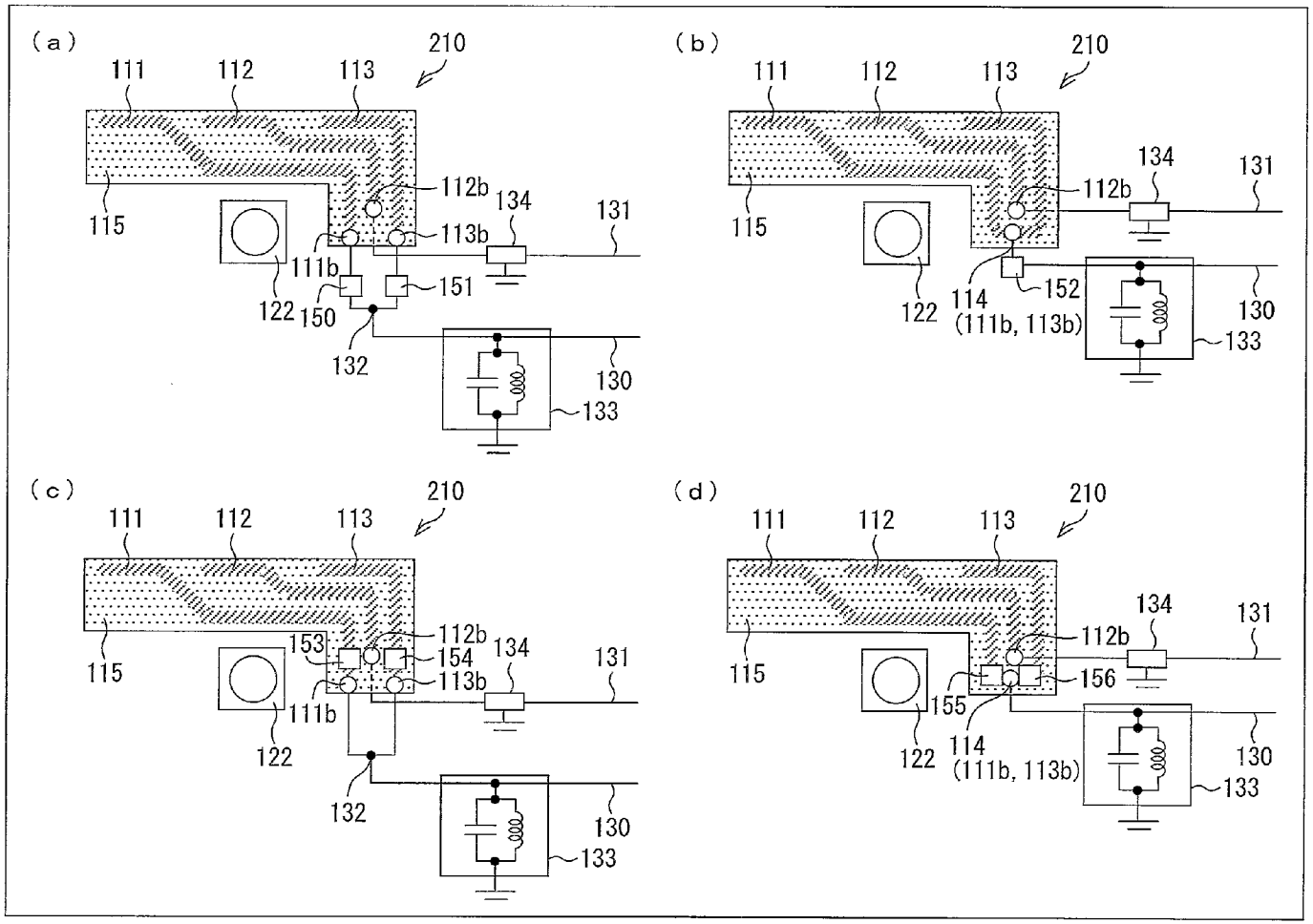
FIG. 10 is a set of diagrams showing variations of antenna including frequency control means according to an embodiment of the present invention.

FIG. 10 shows variations of antenna 210 including frequency control sections 150 to 156. For example, see a case where the antenna 210 is configured, as shown in (a) of FIG. 5, such that the first wire 130 has a branch point 132 at which the first wire 130 divides into two wires one of which is connected to the first connecting end 111*b* and the other one of which is connected to the third connecting end 113*b*. In this case, as shown in (a) of FIG. 10, for example, the frequency control sections 150 and 151 may be provided on the first wire 130 so as to be positioned between the branch point 132 and the first antenna element 111 and between the branch point 132 and the third antenna element 113, respectively, or only either one of them may be provided. Also, see a case where the antenna 210 is configured, as shown in (b) of FIG. 5, such that the first connecting end 111*b* and the third connecting end 113*b* are merged into one. In this case, as shown in (b) of FIG. 10, for example, the frequency control section 150 may be provided on the first wire 130 so as to be positioned between the connecting end 114 and the first matching section 133.

Further, the place in which such a frequency control section is provided is not limited to a place on the first wire 130. For example, such a frequency control section may be provided on the first antenna element 111 or the third antenna element 113. For example, see a case where the antenna 210 is configured as shown in (a) of FIG. 5. In this case, as shown in (c) of FIG. 10, for example, the frequency control section 153 and the frequency control section 154 may be provided halfway on the first antenna element 111 and the third antenna element 113, respectively, or only either one of them may be provided. Also, see a case where the antenna 210 is configured as shown in (b) of FIG. 5. In this case, as shown in (d) of FIG. 10, the frequency control section 155 and the frequency control section 156 may be provided halfway on the first antenna element 111 and the third antenna element 113, respectively, or only either one of them may be provided.

The present invention has been described in concrete terms with reference to the embodiments. However, the present invention is not limited to the description of the embodiments above, but may be altered by a skilled person within the scope of the claims. An embodiment based on a proper combination of technical means disclosed in different embodiments is encompassed in the technical scope of the present invention.

[Summary]

An antenna according to the present invention is an antenna including: a first antenna element which operates in a first frequency band; a second antenna element which operates in a second frequency band that is higher than the first frequency band and which is shorter than the first antenna element; and a third antenna element which operates in a third frequency band that is higher than the second frequency band and which is shorter than the second antenna element, the first, second, and third antenna elements including (i) first, second, and third connecting ends via which the first, second, and third antenna elements are connected to a wireless-section circuit, respectively, (ii) first, second, and third apical ends opposite the first, second, and third connecting ends, respectively, and (iii) first, second, and third apical-end regions including the first, second, and third apical ends, respectively, the second antenna element being placed between the first antenna element and the third antenna element, or the first antenna element being placed between the second antenna element and the third antenna element, the first, second, and third connecting ends being each placed in a position that is closer to the third apical end than to the first apical end.

According to the foregoing configuration, the antenna according to the present invention includes: the first antenna element, which is the longest among the three antenna elements; the second antenna element; and the third antenna element, which is the shortest among the three antenna elements.

For placing such antenna elements while eliminating the difference in radiation efficiency among the frequency bands to which all the antenna elements respectively correspond, it is preferable that the first, second, and third apical-end regions, which most greatly affect antenna characteristics, be placed so as not to be interposed between or covered with any other antenna elements, so that the electromagnetic waves they emit are unlikely to be blocked. According to the foregoing configuration, the third antenna element, which is shortest, is not placed between the two other antenna elements. For example, the third antenna element 113, which is shortest, is placed adjacent to either one of the two other antenna elements, and the other one of the two other antenna elements is placed on the opposite side of the third antenna element with the either one of the two other antenna elements interposed therebetween. With this, none of the antenna elements any longer has its electromagnetic waves blocked by any other one of the antenna elements. That is, this makes it possible to suitably suppress deterioration in antenna characteristics due to a decrease in open space facing the third antenna element interposed between or covered with the two other antenna elements.

Furthermore, for placing the first, second, and third connecting ends 111*b* to 113*b* so that they are not distant from each other, it is necessary that the distance from the area in which the first, second, and third connecting ends are placed to each of the apical ends of the antenna element be such that the distance from the area to the first apical end is longest and that the distance from the area to the third apical end is shortest. This is because the first antenna element is the longest and the third antenna element is the shortest among the antenna elements.

According to the foregoing configuration, the second antenna element is placed between the first antenna element and the third antenna element. Therefore, the first, second, and third apical-end regions are arranged in this order. Moreover, the first, second, and third connecting ends are placed in a position that is closer to the third apical end than to the first apical end. Accordingly, the distance from the area in which the first, second, and third connecting ends are placed to each of the apical ends of the antenna elements satisfies the aforementioned conditions. Consequently, the foregoing configuration makes it possible to achieve an antenna having antenna elements whose connecting parts to a wireless-section circuit are not distant from each other. It should be noted that especially preferably, the first, second, and third connecting ends can each be placed inside of a circle approximately 10 mm in diameter.

Thus, the foregoing configuration makes it possible to achieve an antenna that satisfies the requirements (A) and (B): (A) none of the antenna elements has its antenna characteristics sacrificed; and (B) the connecting parts of the antenna elements to the wireless-section circuits are not distant from each other. This makes it possible to provide an antenna wherein even in a case where the antenna elements are used for an identical system, the difference in radiation efficiency among the frequency bands to which the antenna elements respectively correspond is suppressed.

It should be noted that the antenna is preferably configured such that a shadow of the second antenna element as projected onto a certain plane is interposed between shadows of the first and third antenna elements 111 and 113 as projected onto that plane. Further, the antenna is preferably configured such that the first, second, and third apical-end regions are each placed at a certain end of an antenna placement region in which the antenna is placed. When the first, second, and third connecting ends are placed at a certain end of an antenna placement region in which the antenna is placed and when the end of the antenna placement region is an end that is farthest from a conductive member that is mounted in a portable wireless terminal having the antenna built-in, the first, second, and third apical-end regions can each face an open space distant from the conductive member that blocks the emission of electromagnetic waves. Therefore, the foregoing configuration prevents the electromagnetic waves emitted from the first, second, and third antenna elements from being affected by a conductive member or the like that is mounted in a portable wireless terminal having the antenna built-in. This makes it possible to easily achieve an antenna all of whose antenna elements have the same level of radiation efficiency.

Further, the antenna is preferably configured such that the first, second, and third antenna elements are formed on an identical antenna base.

According to the foregoing configuration, since each antenna element is formed on an identical antenna base, none of the antenna elements is placed in such a manner as to overlap any other one of the antenna elements. That is, each of the antenna elements can successfully avoid deteriorating in characteristics by having its electromagnetic waves blocked by any other one of the antenna elements. This makes it possible to treat the three antenna elements as a single component, thus contributing to a reduction in the number of components to be incorporated into a wireless terminal and to an increase in efficiency of assembly of the wireless terminal.

Further, the antenna is preferably configured to further include a first wire and a second wire via which the antenna is connected to the wireless-section circuit, wherein: the first wire is connected to the first and third antenna elements; and the second wire is connected to the second antenna element. The antenna may be also be configured such that either the first wire has a branch point at which the first wire divides into two wires one of which is connected to the first connecting end and the other one of which is connected to the third connecting end, or the first connecting end and the third connecting end are merged into one.

The foregoing configuration makes it possible to integrate a feeding system from the wireless-section circuit to the first antenna element and a feeding system from the wireless-section circuit to the third antenna element. A large number of feeding systems each require an antenna matching circuit and a connecting end such as a spring that connects a wire on the circuit substrate with the antenna element, and lead to an increase in the amount of space that is occupied by the antenna components, thus leading to an decrease in effective area on the circuit substrate in which another conductive member is mounted. However, the foregoing configuration makes it possible to suppress a decrease in effective area on the circuit substrate in which a conductive member other than the antenna components is mounted.

The antenna is preferable configured such that the first wire is provided with a parallel resonant circuit for matching the first and third antenna elements, the parallel resonant circuit being parallel to the first wire. The antenna is preferable configured such that the parallel resonant circuit has its resonant frequency in the third frequency band.

According to the foregoing configuration, since the parallel resonant circuit has an inductive impedance at a frequency lower than the resonant frequency and has a capacitive impedance at a frequency higher than the resonant frequency, the antenna input impedance as seen from an input side of the first and third antenna elements typically exhibits such a frequency characteristic as that shown in FIG. 9. Therefore, only the antenna input impedance in the second frequency band can be made close to being open, so that the mutual coupling between the first and third antenna elements and the second antenna element can be alleviated.

In particular, in a case where the parallel resonant circuit has its resonant frequency in the third frequency band, the combined impedance of the parallel resonant circuit in the first frequency band becomes inductive and the parallel resonant circuit acts as a parallel L matching circuit, so that the length of the first antenna element can be shortened. That is, the longest antenna element can be made shorter, which is preferable in terms of making the antenna in a smaller size. Further, as for the third antenna element, the presence of the resonant frequency of the parallel resonant circuit in the third frequency band allows the third antenna element to be made broader in band. This also helps the antenna to be made in a smaller size.

Further, the antenna can be configured such that at least any one of (i) the first antenna element, (ii) the third antenna element, and (iii) the first wire includes frequency control means for increasing an input impedance in the second frequency band as seen from an input side of the first and third antenna elements.

According to the foregoing configuration, the frequency control means can increase an input impedance in the second frequency band as seen from an input side of the first and third antenna elements, the input impedance in the second frequency band can be made closer to being open, so that the mutual coupling between the second antenna element and the first and third antenna elements can be more successfully alleviated.

A portable wireless terminal according to the present invention can be a portable wireless terminal including: an antenna according to the present invention; and the wireless-section circuit, the first, second, and third antenna elements being each connected to the wireless-section circuit.

According to the foregoing configuration, since the portable wireless terminal includes an antenna according to the present invention and each antenna element of the antenna are connected to an identical wireless-section circuit, the portable wireless terminal thus provided can make use of the advantages of the antenna according to the present invention.

The portable wireless terminal is preferably configured to further include a housing which houses the antenna, wherein the first, second, and third apical-end regions are placed at an outermost side within the housing.

According to the foregoing configuration, wherein the first, second, and third apical-end regions are placed at an outermost side within the housing, i.e., in a position that is closest to the edge of the housing. This can make the characteristics of each antenna element satisfactory.

Further, an antenna according to the present invention may be an antenna connected to a conductive member provided with a wireless-section circuit, including: a first antenna element which operates in a first frequency band; a second antenna element which operates in a second frequency band that is higher than the first frequency band and which is shorter than the first antenna element; and a third antenna element which operates in a third frequency band that is higher than the second frequency band and which is shorter than the second antenna element, the first, second, and third antenna elements including (i) first, second, and third connecting ends via which the first, second, and third antenna elements are connected to the wireless-section circuit, respectively, (ii) first, second, and third apical ends opposite the first, second, and third connecting ends, respectively, and (iii) first, second, and third apical-end regions including the first, second, and third apical ends, respectively, the first, second, and third apical ends being each placed at a certain end of an antenna placement region in which the antenna is placed, the first, second, and third apical ends being placed farthest in the antenna from the conductive member, the first, second, and third apical ends being not covered with any other one of the antenna elements as seen from a side opposite to a side on which the conductive member is placed, the first, second, and third antenna elements being arranged in this order with increasing distances from a place that is close to the conductive member, the first, second, and third connecting ends being each placed in a position that is closer to the third apical end than to the first apical end. It should be noted that especially preferably, the first, second, and third connecting ends can each be placed inside of a circle approximately 10 mm in diameter. The antenna thus configured can also bring about the same effects as the aforementioned antenna can.

An antenna according to the present invention is suitably applicable also in a case where all the antenna elements are used for utilizing a plurality of system.

Industrial Applicability

The present invention is suitably applicable to antennas for use in wireless communication in general and, in particular, to antennas for portable wireless terminals and the field of manufacture of portable terminals including such antennas.

REFERENCE SIGNS LIST

100 Portable wireless terminal
101 First housing
102 Second housing
103 Connection member
110 Antenna
111 First antenna element
112 Second antenna element
113 Third antenna element
111*a* First apical end
112*a* Second apical end
113*a* Third apical end
111*b* First connecting end
112*b* Second connecting end
113*b* Third connecting end
111*c* First apical-end region
112*c* Second apical-end region
113*c* Third apical-end region
114 Connecting end
115 Antenna base
120 Circuit substrate
121 Wireless-section circuit
121*a* First circuit load
121*b* Second circuit load
122 Camera
130 First wire
131 Second wire
132 Branch point
133 First matching section
134 Second matching section
146 First not-in-use terminal
147 Second not-in-use terminal
150 to 156 Frequency control section (frequency control means)

The invention claimed is:

1. An antenna connected to a conductive member provided with a wireless-section circuit, comprising:

a first antenna element which operates in a first frequency band;

a second antenna element which operates in a second frequency band that is higher than the first frequency band and which is shorter than the first antenna element; and a third antenna element which operates in a third frequency band that is higher than the second frequency band and which is shorter than the second antenna element, the first, second, and third antenna elements including (i) first, second, and third connecting ends via which the first, second, and third antenna elements are connected to the wireless-section circuit, respectively, (ii) first, second, and third apical ends opposite the first, second, and third connecting ends, respectively, and (iii) first, second, and third apical-end regions including the first, second, and third apical ends, respectively, the first, second, and third connecting ends are placed in an area and proximate to each other, the first, second, and third antenna elements being arranged in this order with increasing distances from a place that is close to the conductive member, the conductive member blocking radiation from the antenna, the first, second, and third apical ends being not covered with any other one of the antenna elements as seen from a side opposite to a side on which the conductive member is placed, the area in which the first, second, and third connecting ends being each placed in a position that is closer to the third apical end than to the first apical end.

2. The antenna as set forth in claim 1, wherein the first, second, and third apical ends are placed farthest in the antenna from the conductive member.

3. The antenna as set forth in claim 1, wherein the first, second, and third apical ends are not covered with any other one of the antenna elements as seen (i) from a side on which the first, second, and third apical ends are placed in an antenna placement region in which the antenna is placed toward (ii) the conductive member.

4. The antenna as set forth in claim 1, further comprising a first wire and a second wire via which the antenna is connected to the wireless-section circuit, wherein:

the first wire is connected to the first and third antenna elements; and the second wire is connected to the second antenna element.

5. The antenna as set forth in claim 4, wherein the first wire is provided with a parallel resonant circuit for matching the first and third antenna elements, the parallel resonant circuit being parallel to the first wire.

6. An antenna comprising:

a first antenna element which operates in a first frequency band;

a second antenna element which operates in a second frequency band that is higher than the first frequency band and which is shorter than the first antenna element; and a third antenna element which operates in a third frequency band that is higher than the second frequency band and which is shorter than the second antenna element, the first, second, and third antenna elements including (i) first, second, and third connecting ends via which the first, second, and third antenna elements are connected to a wireless-section circuit, respectively, (ii) first, second, and third apical ends opposite the first, second, and third connecting ends, respectively, and (iii) first, second, and third apical-end regions including the first, second, and third apical ends, respectively, the first, second, and third connecting ends being each placed in a position that is closer to the third apical end than to the first apical end, the second antenna element being placed between the first antenna element and the third antenna element, or the first antenna element being placed between the second antenna element and the third antenna element, said antenna further comprising a first wire and a second wire via which the antenna is connected to the wireless-section circuit, the first wire being connected to the first and third antenna elements, the second wire being connected to the second antenna element, the first wire being provided with a parallel resonant circuit for matching the first and third antenna elements, the parallel resonant circuit being parallel to the first wire, the parallel resonant circuit having its resonant frequency in the third frequency band.

7. The antenna as set forth in claim 4, wherein at least any one of (i) the first antenna element, (ii) the third antenna element, and (iii) the first wire includes frequency control means for increasing an input impedance in the second frequency band as seen from an input side of the first and third antenna elements.

8. The antenna as set forth in claim 4, wherein the first connecting end and the third connecting end are merged into one.

9. The antenna as set forth in claim 4, wherein the first wire has a branch point at which the first wire divides into two wires one of which is connected to the first connecting end and the other one of which is connected to the third connecting end.

10. The antenna as set forth in claim 1, wherein the first, second, and third apical-end regions are each placed at a certain end of an antenna placement region in which the antenna is placed.

11. The antenna as set forth in claim 1, wherein a shadow of the second antenna element as projected onto a certain plane is interposed between shadows of the first and third antenna elements and as projected onto that plane.

12. The antenna as set forth in claim 1, wherein the first, second, and third antenna elements are formed on an identical antenna base.

13. A portable wireless terminal comprising:

an antenna as set forth in claim 1; and the wireless-section circuit, the first, second, and third antenna elements being each connected to the wireless-section circuit.

14. The portable wireless terminal as set forth in claim 13, further comprising a housing which houses the antenna, wherein the first, second, and third apical-end regions are placed at an outermost side within the housing.

15. An antenna connected to a conductive member provided with a wireless-section circuit, comprising:

a first antenna element which operates in a first frequency band;

a second antenna element which operates in a second frequency band that is higher than the first frequency band and which is shorter than the first antenna element; and a third antenna element which operates in a third frequency band that is higher than the second frequency band and which is shorter than the second antenna element, the first, second, and third antenna elements including (i) first, second, and third connecting ends via which the first, second, and third antenna elements are connected to the wireless-section circuit, respectively, (ii) first, second, and third apical ends opposite the first, second, and third connecting ends, respectively, and (iii) first, second, and third apical-end regions including the first, second, and third apical ends, respectively, the first, second, and third apical ends being each placed at a certain end of an antenna placement region in which the antenna is placed, the first, second, and third connecting ends are placed in an area and proximate to each other, the first, second, and third apical ends being placed farthest in the antenna from the conductive member, the conductive member blocking radiation from the antenna, the first, second, and third apical ends being not covered with any other one of the antenna elements as seen from a side opposite to a side on which the conductive member is placed, the first, second, and third antenna elements being arranged in this order with increasing distances from a place that is close to the conductive member, the first, second, and third connecting ends being each placed in a position that is closer to the third apical end than to the first apical end.

* * * * *